US009481938B2

(12) United States Patent
Shin et al.

(10) Patent No.: US 9,481,938 B2
(45) Date of Patent: Nov. 1, 2016

(54) ELECTROCHEMICAL REDUCTION METHOD OF CARBON DIOXIDE USING SOLUTION CONTAINING POTASSIUM SULFATE

(71) Applicants: Sogang University Research Foundation, Seoul (KR); Korea Southern Power Co., Ltd., Seoul (KR)

(72) Inventors: Woonsup Shin, Seoul (KR); Sae Young Oh, Seoul (KR); Suk Kyu Kim, Guri-si (KR); Mi Jung Park, Seoul (KR)

(73) Assignees: Sogang University Research Foundation, Seoul (KR); Korea Southern Power Co., Ltd., Seoul (KR)

( * ) Notice: Subject to any disclaimer, the term of this patent is extended or adjusted under 35 U.S.C. 154(b) by 0 days.

(21) Appl. No.: 14/449,711

(22) Filed: Aug. 1, 2014

(65) Prior Publication Data

US 2015/0047986 A1 Feb. 19, 2015

(30) Foreign Application Priority Data

Aug. 19, 2013 (KR) ..... 10-2013-0097982

(51) Int. Cl.
*C25B 3/00* (2006.01)
*C25B 1/00* (2006.01)
*C25B 3/04* (2006.01)

(52) U.S. Cl.
CPC ..... *C25B 3/04* (2013.01)

(58) Field of Classification Search
CPC ..... C25B 1/00; C25B 3/00; C25B 3/02; C25B 3/04; C25B 11/18
USPC ..... 205/413, 457, 555
See application file for complete search history.

(56) References Cited

U.S. PATENT DOCUMENTS

2012/0228147 A1* 9/2012 Sivasankar ..... C25B 1/003 205/440

FOREIGN PATENT DOCUMENTS

KR 10-0468049 B 1/2005
WO WO 2012/040503 3/2012

OTHER PUBLICATIONS

Kaneco et al, "Electrochemical Reduction of Carbon Dioxide on Copper in Methanol with Various Potassium Supporting Electrolytes at Low Temperature" (no month, 1999), J Solid State Electrochem, vol. 3, pp. 424-428.*

Wu et al., "Electrochemical Reduction of Carbon Dioxide I. Effects of the Electrolyte on the Selectivity and Activity with Sn Electrode," Journal of the Electrochemical Society (no month, 2012), vol. 159, No. 7, pp. F353-F359.*

Augustynski et al., "Electroreduction of Carbon Dioxide in Aqueous Solutions at Metal Electrodes", Preprints of Papers—American Chemical Society, Division of Fuel Chemistry (no month, 1996), vol. 41, No. 4, pp. 1420-1424.*

(Continued)

*Primary Examiner* — Edna Wong
(74) *Attorney, Agent, or Firm* — Greer, Burns & Crain, Ltd.

(57) ABSTRACT

The embodiments described herein pertain generally to an electrochemical reduction method of carbon dioxide under a solution condition containing potassium sulfate.

5 Claims, 7 Drawing Sheets

(56) References Cited

OTHER PUBLICATIONS

Wu et al., "Electrochemical Reduction of Carbon Dioxide II. Design, Assembly, and Performance of Low Temperature Full Electrochemical Cells," Journal of the Electrochemical Society (no month, 2013), vol. 160, No. 9, pp. F953-F957.*

M. Jitaru et al., "Electrochemical reduction of carbon dioxide on at metallic cathodes", Journal of Appplied Electrochemistry. Aug. 1997, vol. 27, pp. 875-889.

* cited by examiner

PRIOR ART

ELECTROCHEMICAL REDUCTION METHOD OF CARBON DIOXIDE USING SOLUTION CONTAINING POTASSIUM SULFATE

This application claims the priority benefit under 35 U.S.C. 119(a) to Korean Patent Application No. 10-2013-0097982 filed on Aug. 19, 2013, in the Korean Intellectual Property Office, the contents of all of which are incorporated herein by reference in their entirety.

TECHNICAL FIELD

The embodiments described herein pertain generally to an electrochemical reduction method of carbon dioxide under a solution condition containing potassium sulfate.

BACKGROUND

Gases affecting the global warming are called greenhouse games and such greenhouse gases include carbon dioxide, methane, CFC and so on. According to the announcements reported in 2010, an emission amount of carbon dioxide over the world was about 33 billion tons, which was an increase of about 45% over the emission amount in 1990, and Korea ranked the $7^{th}$ in the world in the emission amount of carbon dioxide and the $3^{rd}$ in the increase rate of the amount. Foreign advanced countries have already led to reduce the emission amount of carbon dioxide by introducing the emission trading system or the carbon tax system.

With respect to methods for reducing the emission amount of carbon dioxide, there are generally capture, storage and conversion processes. Carbon dioxide capture and storage (CCS) technology isolates carbon dioxide discharged from big emission sources such as power, steel, and cement plants and so on from the air, and is a core technology occupying from 70% to 80% of whole expenses. Captured carbon dioxide may be stored in the ocean, under the ground, on the ground surface and others, but the storage in the ocean may cause a problem in the marine ecosystem, and the storage on the ground surface is still at the initial technology stage due to problems in storing places and others. Further, in view of transportation of captured carbon dioxide, there is a difficulty in widely commercializing the technology. In light of the foregoing, the process for conversion of carbon dioxide holds a prevailing position in both environmental and economic aspects, and can resolve the aforementioned problems, especially, through an electrochemical conversion method.

Conversion of carbon dioxide using electric energy can convert carbon monoxide, formic acid, methanol, methane and others into various organic compounds by reacting them through an electrode reaction under a condition of a room temperature and an atmospheric pressure depending on types of electrode materials and reaction conditions. In an electrochemical conversion method, since potential differences of reduction of carbon dioxide and generation of hydrogen in an aqueous solution are significantly close to each other, the reduction of carbon dioxide is interrupted by the competition of the two reactions. Accordingly, it is necessary to use an electrode having a large overpotential to the generation of hydrogen and a catalyst or an electrode surface for selectively converting only carbon dioxide.

In recent, researchers have actively studied for formic acid, and the formic acid is used to keep foods necessary for livestock breeding fresh and also used in a small amount as a preservative for foods. Besides, formic acid may be used as a fuel of a formic acid fuel cell, and the current price of formic acid to input energy is the highest in other materials that can be subject to be converted. Formic acid is disadvantageous in that, despite the tendency for the price of formic acid to have increased each year, uses of formic acid are still a few. Recently, many researches on a method that produces formic acid by electrolyzing carbon dioxide have been conducted (Korean Patent No. 10-468049).

DISCLOSURE OF THE INVENTION

Problems to be Solved by the Invention

In view of the foregoing, the present disclosure provides an electrochemical reduction method of carbon dioxide using a solution condition containing potassium sulfate.

However, the problems sought to be solved by the present disclosure are not limited to the above description, and other problems can be dearly understood by those skilled in the art from the following description.

Means for Solving the Problems

In a first aspect of the present disclosure provides an electrochemical reduction method of carbon dioxide, which comprises reacting carbon dioxide in a solution condition containing potassium sulfate.

Means for Solving the Problems

The electrochemical reduction method of carbon dioxide in accordance with the present disclosure can electrochemically reduce carbon dioxide in a stable and effective manner to convert it into formic acid, by converting the carbon dioxide under a solution condition containing potassium sulfate. Furthermore, since efficiency of the conversion into formic acid and its economic efficiency are superior, carbon dioxide can be reconverted into useful materials at low costs with simultaneously, processing carbon dioxide so that high added values can be created.

DETAILED DESCRIPTION

Figure 1:
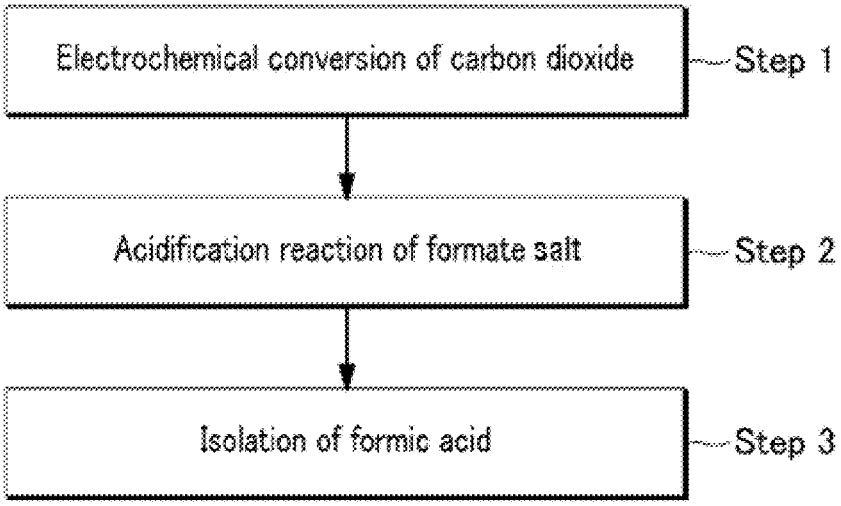
FIG. 1 schematically shows an electrochemical conversion process of carbon dioxide in accordance with an illustrative embodiment of the present disclosure.

Hereinafter, embodiments will be described in detail with reference to the accompanying drawings so that inventive concept may be readily implemented by those skilled in the art. However, it is to be noted that the present disclosure is not limited to the embodiments but can be realized in various other ways. In the drawings, certain parts not directly relevant to the description are omitted to enhance the clarity of the drawings, and like reference numerals denote like parts throughout the whole document of the present disclosure.

Throughout the whole document of the present disclosure, the terms "connected to" or "coupled to" are used to designate a connection or coupling of one element to another element and include both a case where an element is "directly connected or coupled to" another element and a case where an element is "electronically connected or coupled to" another element via still another element.

Throughout the whole document of the present disclosure, the term "on" that is used to designate a position of one element with respect to another element includes both a case that the one element is adjacent to the another element and a case that any other element exists between these two elements.

Throughout the whole document of the present disclosure, the term "comprises or includes" and/or "comprising or including" used in the document means that one or more other components, steps, operations, and/or the existence or addition of elements are not excluded in addition to the described components, steps, operations and/or elements. Throughout the whole document of the present disclosure, the terms "about or approximately" or "substantially" are intended to have meanings close to numerical values or ranges specified with an allowable error and intended to prevent accurate or absolute numerical values disclosed for understanding of the present invention from being illegally or unfairly used by any unconscionable third party.

Throughout the whole document of the present disclosure, the term "step of" does not mean "step for."

Throughout the whole document of the present disclosure, the term "combination of" included in Markush type description means mixture or combination of one or more components, steps, operations and/or elements selected from a group consisting of components, steps, operation and/or elements described in Markush type and thereby means that the disclosure includes one or more components, steps, operations and/or elements selected from the Markush group.

Throughout the whole document of the present disclosure, the expression "A and/or B" means "A or B, or A and B."

Hereinafter, illustrative embodiments and Examples of the present disclosure will be described in detail with reference to the accompanying drawings. However, the present disclosure may not be limited to the illustrative embodiments, Examples and drawings.

The first aspect of the present disclosure provides an electrochemical reduction method of carbon dioxide, which comprises reacting carbon dioxide under a solution condition containing potassium sulfate.

In accordance with an illustrative embodiment of the present disclosure, the electrochemical reduction method of carbon dioxide may be largely divided into the following three (3) steps: electrochemical conversion of carbon dioxide, acidification of a formate salt, and isolation of formic acid, but the present disclosure may not be limited thereto (FIG. 1). As illustrated in FIG. 1, the first step converts carbon dioxide into a formate salt (e.g., HCOOK or HCOONa) through an electrode reaction in an electrolytic reactor. The second step acidifies the produced formate salt by adding sulfuric acid ($H_2SO_4$) or hydrochloric acid (HCl) to convert the formate salt into formic acid (HCOOH). After the acidification, the third step isolates the produced formic acid (HCOOH) through distillation.

Figure 2:
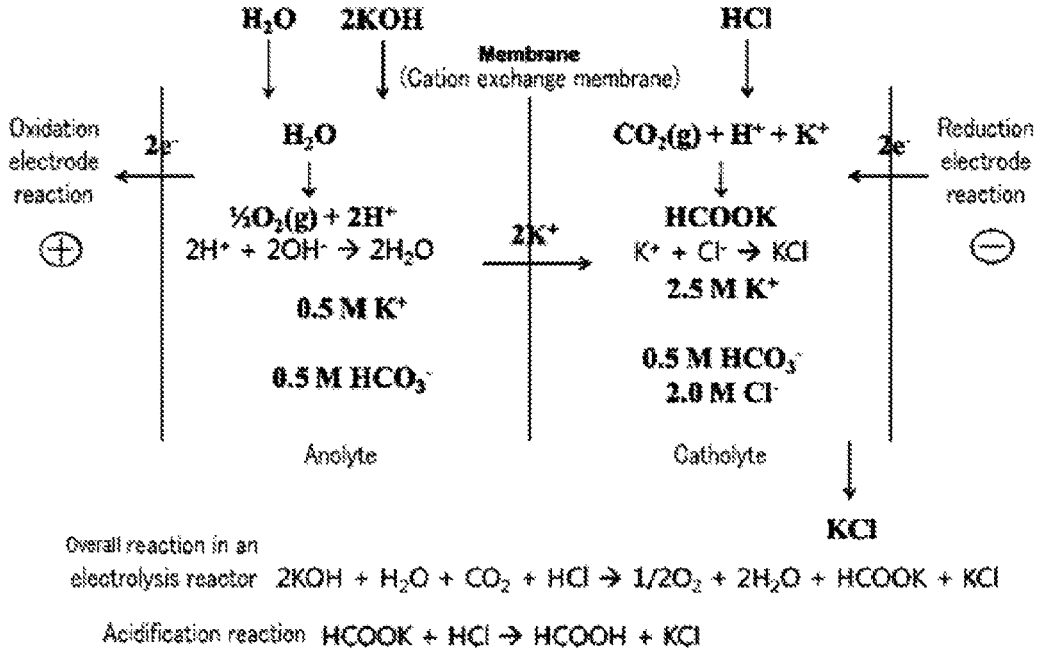
FIG. 2 is a flow chart of an electrochemical conversion process of carbon dioxide under a conventional solution condition.

A conventional solution condition containing a bicarbonate ion ($HCO_3^-$) has been researched and used the most since it can maintain high conversion efficiency and perform a pH buffer action upon electrochemical conversion of carbon dioxide. However, if the process is actually performed in the bicarbonate ion condition, it does not result in any economic profits in view of costs for electric energy to be consumed and prices of solutions. As illustrated in FIG. 2, in the electrochemical reduction method of carbon dioxide under the conventional solution condition, a reduction electrode unit is in a solution condition, in which about 0.5 M $KHCO_3$ and about 2 M KCl are mixed with each other, and an oxidation electrode unit is in a solution condition of about 0.5 M $KHCO_3$. In order to maintain the balance between ions and materials in the solutions while the electrochemical conversion of carbon dioxide occurs, transfer of the ions occurs as indicated in FIG. 2. To be more specific, an oxygen gas and $H^+$ are generated by an oxidation reaction of water in the oxidation electrode unit, but since $K^+$ cations are the most fluent as a cation in the solution, $K^+$ cations move toward the reduction electrode unit through a cation exchange membrane such that the ion balance maintained. In the reduction electrode unit, carbon dioxide consumes $H^+$ and $K^+$ by electrochemical reduction to be converted into a formate salt (HCOOK). Thus, in order to enable continuous occurrence of the electrochemical reaction in the oxidation electrode unit and the reduction electrode unit, KOH should be continuously supplied for the balance of the oxidation electrode unit, and HCl should be continuously supplied to the reduction electrode unit. In this case, KCl will be continuously precipitated in the reduction electrode unit. Therefore, it becomes a process in which formate salt, KCl, an oxygen gas, and water are produced and KOH and HCl should be continuously supplied from the outside.

As described, since the electrode reaction of carbon dioxide occurs in a neutral condition, a material obtained from the conversion is a formate salt, and in order to convert the formate salt into formic acid, the formate salt should be acidified by adding HCl or others. In this case, KCl is also discharged as a by-product of the reaction. The produced formic acid is isolated and thus obtained from water as a solvent through a distillation or extraction method.

As a result of evaluating economic efficiency of a process that produces about one (1) ton of formic acid through the above-described process, there is loss of about 425 dollars per production of about one (1) ton of formic acid, upon considering the prices of the solutions that should be continuously supplied from the outside. In addition, the conventional process needs to further include step of isolating KCl and $KHCO_3$ which remain in a solid form together after the distillation, but such isolating process is very difficult and cannot be thus easily accomplished.

Figure 3:
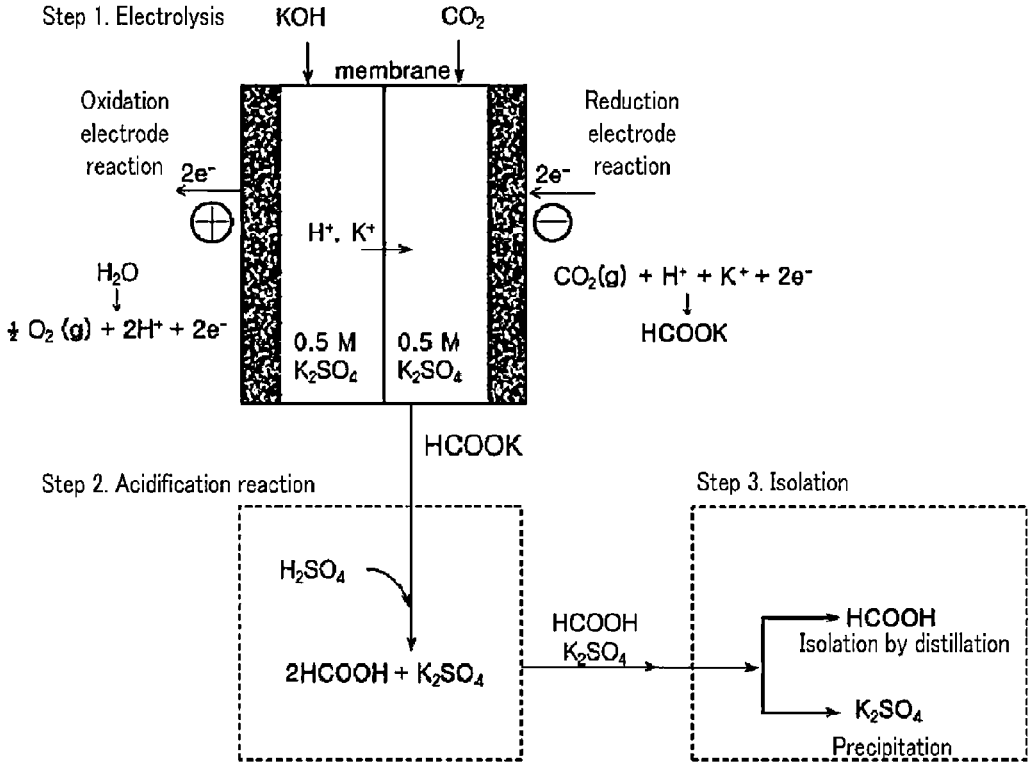
FIG. 3 is a flow chart of an electrochemical conversion process of carbon dioxide under a solution condition containing potassium sulfate in accordance with an illustrative embodiment of the present disclosure.

For the electrochemical reduction method of carbon dioxide in accordance with the present disclosure, am illustrated in FIG. 3, both the oxidation electrode unit and the reduction electrode unit have the potassium sulfate solution condition, and a process for producing formic acid through an acidification reaction and an isolating process after the electrode reaction can be accomplished.

As illustrated in FIG. 3, oxygen is generated while producing $H^+$ in the oxidation electrode unit as a result of the oxidation reaction of water, and $K^+$ and $H^+$ on the solution move over into the reduction electrode unit through the cation membrane. In the reduction electrode unit, carbon dioxide is converted into a formate salt (HCOOK) by an electrode reaction. For the balance of ions during the process, KOH needs to be continuously injected into the oxidation reaction unit. In the acidification reaction of the second step, when two (2) equivalent weights of formic acid are produced by using sulfuric acid ($H_2SO_4$), one (1) equivalent weight of potassium sulfate is produced. In the third step, formic acid is isolated through distillation, and potassium sulfate is isolated through precipitation so that a relatively simple isolating process can be operated. As a result of evaluating economic efficiency of converting carbon dioxide into formic acid through the above-described process, it is identified that the conversion results in an economic effect of about 1,000 dollars per production of one (1) ton of formic acid, which is an increase of about 2.5 times over the conventional solution condition.

In accordance with an illustrative embodiment of the present disclosure, the electrochemical reduction method of carbon dioxide may include, supplying a solution containing carbon dioxide and potassium sulfate into a reduction electrode unit in an electrochemical reactor; supplying a solution containing potassium sulfa into an oxidation electrode unit in the electrochemical reactor; and applying current to the reduction electrode and the oxidation electrode to reduce carbon dioxide, but may not be limited thereto.

The reduction electrode may contain an amalgam electrode, but may not be limited thereto. For example, the amalgam electrode may include dental amalgam, but may not be limited thereto. The dental amalgam is produced by mixing mercury and amalgam powders with each other and may include Hg of from about 35 wt % to about 55 wt %, Ag of from about 14 wt % to about 34 wt %, Sn of from about 7 wt % to about 17 wt %, and Cu of from about 4 wt % to about 24 wt %, but may not be limited thereto. The amalgam powders may be classified into a low-copper amalgam and a high-copper amalgam according to an amount of Cu. Since the low-copper amalgam is known to be relatively easily subject to corrosion, it would be preferable to use the high-cupper amalgam as a final electrode material, but the amalgam powders in the present disclosure may not be limited to the high-copper amalgam. Amalgam is formed by mixing liquid mercury and an amalgam powders with each other at a rapid rate by means of an amalgamator, and this process is called an amalgam setting reaction. For example, ANA 2000 amalgam powders of Nordiska contains Ag, Sn, and Cu in amounts of about 43.1 wt %, about 30.8 wt %, and about 26.1 wt %, respectively. A dental amalgam is made by mixing the amalgam powders with liquid mercury at a weight ratio of about 55% for the amalgam powders and about 45% for the liquid mercury. For example, a dental amalgam may be finally produced with a composition of Hg (45 wt %), Ag (24 wt %), Sn (17 wt %), and Cu (14 wt %). When an amalgam electrode is formed by using a dental amalgam, the amalgam immediately after its production is like clay, and thus, can be processed to have a desired shape.

In accordance with an illustrative embodiment of the present disclosure, the amalgam electrode may be formed in various shapes according to necessity, and for example, but may not be limited thereto, a rod or a planar shape, but may not be limited thereto. In addition, the amalgam electrode may further include a copper or tin electrode on one surface thereof so as to enable the amalgam to well conduct electricity, but the present disclosure may not be limited thereto. For example, in case of a rod-shaped amalgam electrode, after a front part of a copper rod is processed to be a sharp point, it fits into a Tefron tubing, and the space between the copper rod and the tubing is filled with dental amalgam. Curing of the amalgam is completed by about 90% or more after lapse of about 24 hours from the formation of the amalgam, and the Tefron tubing may be removed after about 48 hours for complete curing such that the amalgam can be used as an electrode. The use of the copper rod enables the amalgam to well conduct electricity, and simultaneously, the copper rod serves as a support. Further, in order to prevent a reaction of the copper rod at the time of electrolysis, a boundary between the amalgam and the copper rod may be sealed with a Tafron tape and a heat shrinkable tube so that the copper rod can be prevented from being exposed to a solution, but may not be limited thereto.

For example, an amalgam electrode in a planar shape is formed by pushing amalgam, which has been mixed by an amalgamator, into a corresponding space of a mold made of acryl, stainless steel or others and having an appropriate size. In order to make the surface of the electrode flat, an instrument like a chisel capable of applying force uniformly to the whole surface may be used. In addition, for electric connection, conductors in various shapes like a copper plate may be added to the mold for the production of the amalgam electrode. The planar amalgam electrode is also used after curing of the amalgam for at least 24 hours, but the present disclosure may not be limited thereto.

In accordance with an illustrative embodiment, the current may be, for example, from about 2 $mA/cm^2$ to about 50 $mA/cm^2$, from about 2 $mA/cm^2$ to about 40 $mA/cm^2$, from about 2 $mA/cm^2$ to about 30 $mA/cm^2$, from about 2 $mA/cm^2$ to about 20 $mA/cm^2$, from about 2 $mA/cm^2$ to about 10 $mA/cm^2$, from about 10 $mA/cm^2$ to about 50 $mA/cm^2$, from about 20 $mA/cm^2$ to about 50 $mA/cm^2$, from about 30 $mA/cm^2$ to about 50 $mA/cm^2$, or from about 40 $mA/cm^2$ to about 50 $mA/cm^2$, but may not be limited thereto.

In accordance with an illustrative embodiment of the present disclosure, carbon dioxide can be converted into formic acid by the electrochemical reduction method of carbon dioxide, and the conversion current efficiency may be about 50% or more, and for example, but not be limited thereto, about 60% or more, about 70% or more, about 50% or more, about 90% or more, about 95% or more, from about 50% to about 95%, from about 60% to about 95%, from about 70% to about 95%, from about 50% to about 95%, from about 50% to about 90%, from about 50% to about 80%, from about 50% to about 70%, or from about 50% to about 60%, but may not be limited thereto.

In accordance with an illustrative embodiment of the present disclosure, a concentration of the solution containing potassium sulfate may be from about 0.1 M to about 10 M, and for example, from about 0.1 M to about 7 M, from about 0.1 M to about 5 M, from about 0.1 M to about 2 M, from about 0.1 M to about 1 M, from about 0.1 M to about 0.5 M, from about 0.5 M to about 10 M, from about 0.5 M to about 7 M, from about 0.5 M to about 5 M, from about 0.5 M to about 2 M, from about 0.5 M to about 1 M, from about 1 M to about 10 M, from about 2 M to about 10 M, from about 5 M to about 10 M, or from about 7 M to about 10 M, but may not be limited thereto.

In accordance with an illustrative embodiment of the present disclosure, continuously adding a solution containing KOH to the oxidation electrode unit to control pH may be included, and for example, pH may be controlled to be from about 7 to about 8, but may not be limited thereto.

Hereinafter, preferable Examples of the present disclosure are described. However, the Examples are merely illustrative to facilitate understanding of the present disclosure, and the present disclosure is not limited to the Examples.

EXAMPLE

Example 1

Figure 4A:
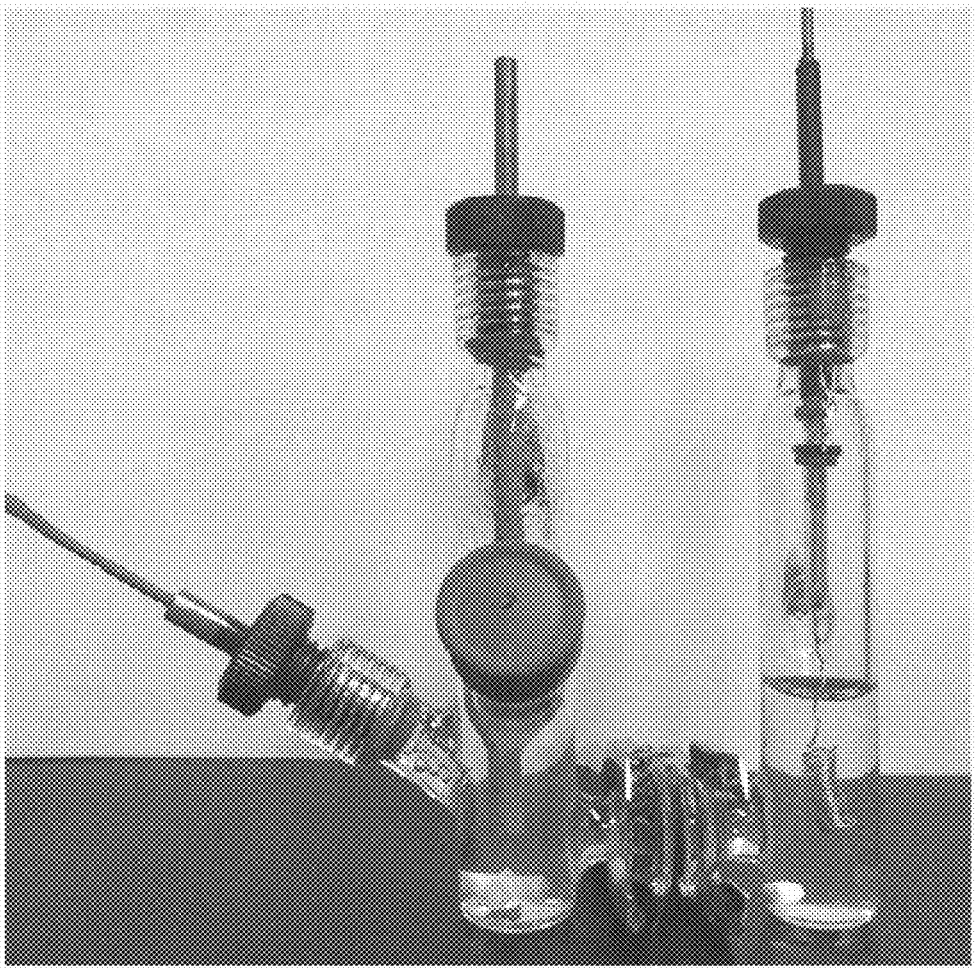
FIG. 4A and FIG. 4B show an electro-reduction system in a laboratory scale under a solution condition containing potassium sulfate in accordance with an example of the present disclosure.

Prior to performing an actual process, a basic experiment for conversion of carbon dioxide in a laboratory scale was conducted. For the experimental method, a constant current (5 mA/cm$^2$) was applied, and conversion efficiency was calculated by a charge amount for an amount of carbon dioxide converted into formic acid to a whole amount of flowing charge. FIG. 4A shows a shape of a H-type cell used in the experiment.

A H-type cell, in which each of the solutions of the oxidation electrode unit and the reduction electrode unit has a volume of about 10 mL, was used, and for both the solutions, an about 0.5 M $K_2SO_4$ solution was used. A rod-shaped dental amalgam electrode having an about 3.5 cm$^2$ area was used as a reduction electrode, and a platinum electrode was used as an oxidation electrode. During the electrolysis, the solutions were uniformly stirred by using a magnetic stirrer, and the produced formate salt was quantified by using HPLC. In order to maintain pH to be from about 7 to about 8 during the electrochemical conversion, about 1 M KOH was gradually added. Efficiency of the conversion of carbon dioxide into formic acid was calculated from the amount of flowing charge and the concentration of the produced formate salt.

Figure 5:
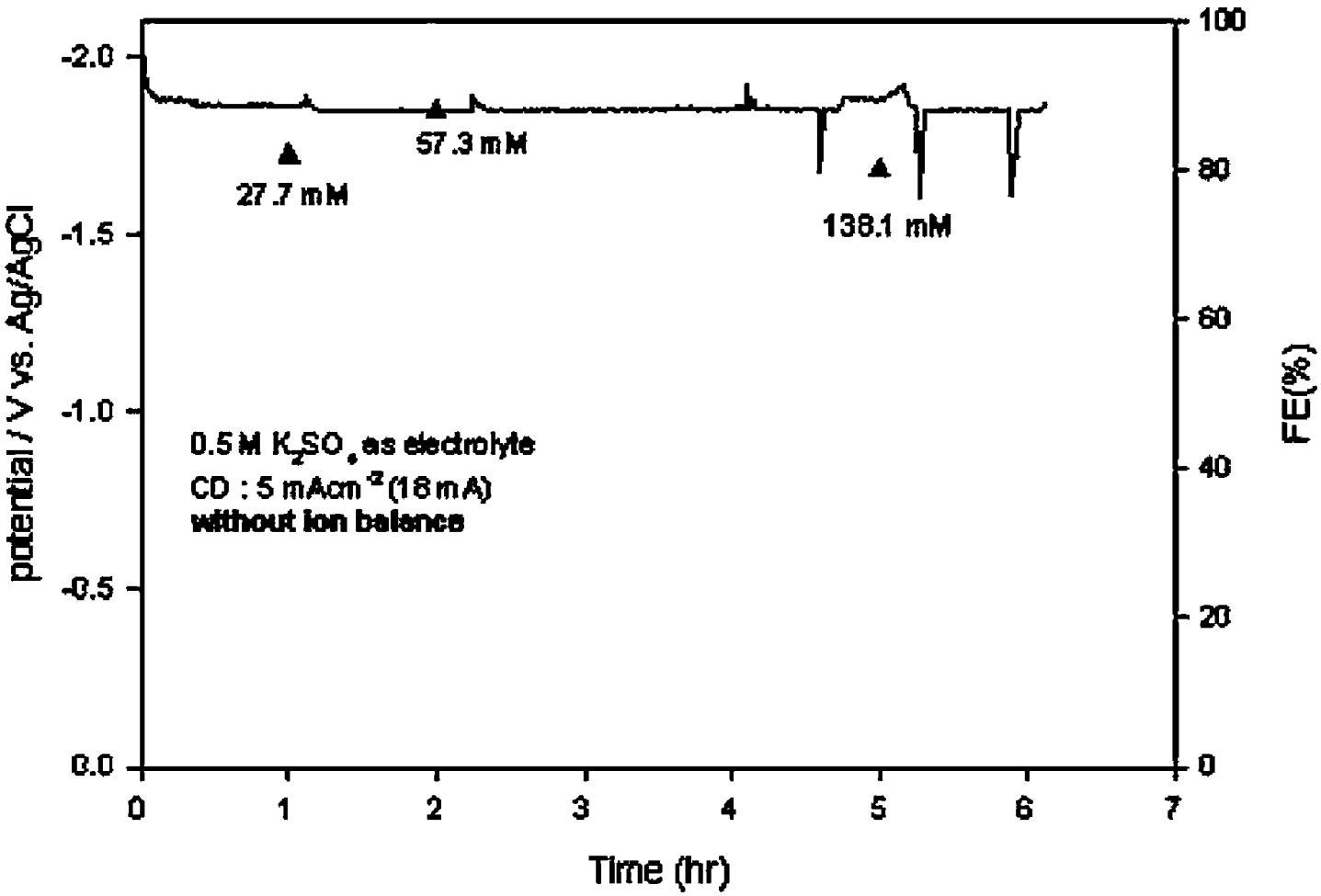
FIG. 5 is a graph showing a potential of a reduction electrode upon electrolysis of carbon dioxide under a solution condition containing potassium sulfate in accordance with an example of the present disclosure.

FIG. 5 illustrates a potential value of the reduction electrode according to the time when the electrolysis was conducted with the constant current of about 5 mA/cm$^2$. In this case, the conversion efficiency was about 80% or more.

Example 2

Figure 4B:
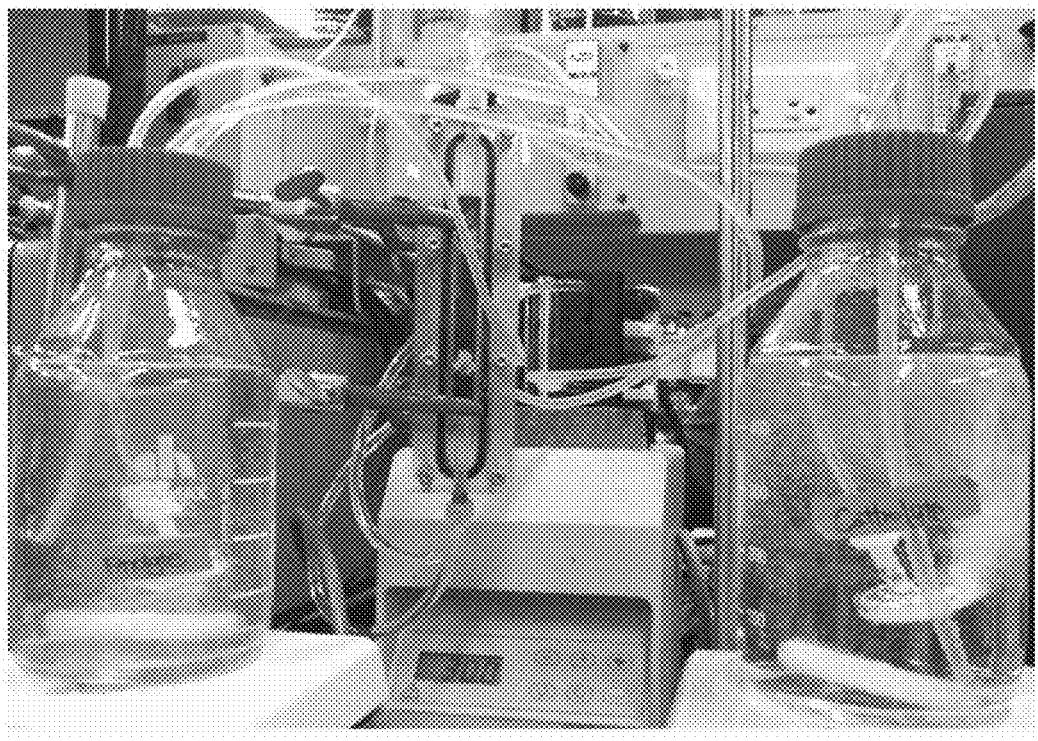

A basic experiment for conversion of carbon dioxide in a laboratory scale was conducted by using a flow cell as shown in FIG. 4B.

A flow cell, in which each of the solutions of the oxidation electrode unit and the reduction electrode unit has a volume of about 250 mL, was used, and for both the solutions, an about 0.5 M $K_2SO_4$ solution was used. A plate-shaped dental amalgam electrode having an about 10 cm$^2$ area was used as a reduction electrode, and a Ti plate having the same size as the reduction electrode and coated with $RuO_2$ was used as an oxidation electrode. The solutions were circulated at about 30 mL/min rate through a pump during the electrolysis, and in order to maintain the ion balance of the whole reaction, a KOH solution was properly injected from the outside into the oxidation electrode unit. The produced formate salt was quantified by using HPLC. Efficiency of the conversion of carbon dioxide into formic acid was calculated from the amount of flowing charge and the concentration of the produced formate salt.

Figure 6:
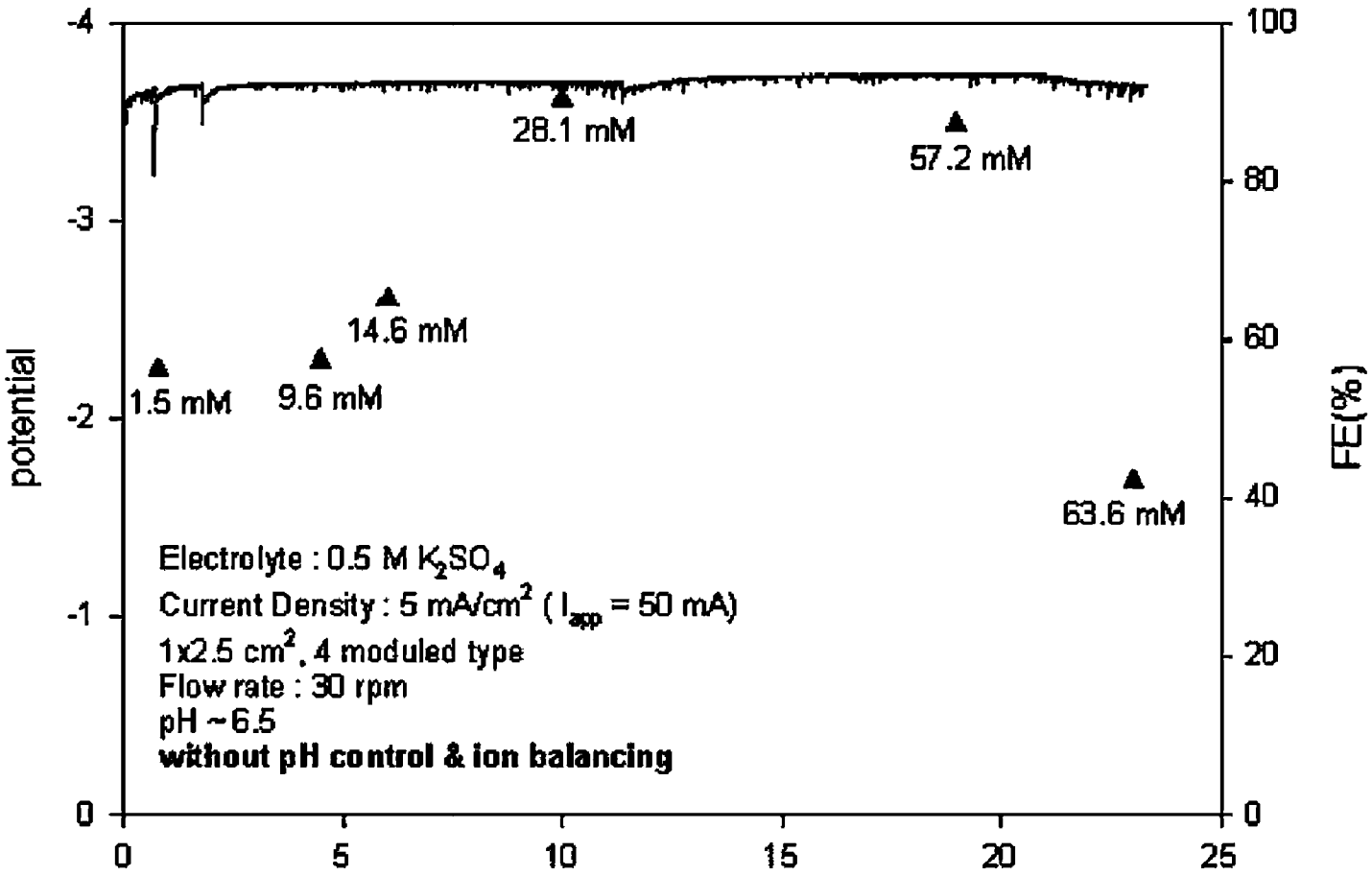
FIG. 6 is a graph showing a voltage to an oxidation electrode of a reduction electrode upon electrolysis of carbon dioxide under a solution condition containing potassium sulfate in accordance with an example of the present disclosure.

FIG. 6 shows a voltage of the reduction electrode to the oxidation electrode according to time when the electrolysis was conducted with the static current of about 5 mA/cm$^2$. In this case, the conversion efficiency was from about 60% to about 30%. A pH value for an electrolyte in the reduction electrode unit was about 6.5 during the electrochemical conversion of carbon dioxide for about 24 hours, and a pH value of the oxidation electrode unit was maintained at about 3.0.

Comparative Example 1

As illustrated in FIG. 2, formic acid was produced by electrochemically reducing carbon dioxide under a conventional solution condition containing bicarbonate ion ($HCO_3^-$).

A solution obtained by mixing about 0.5 M $KHCO_3$ and about 2 M KCl with each other was used for the reduction electrode unit, and an about 0.5 M $KHCO_3$ solution was used for the oxidation electrode unit. KOH was continuously supplied for the balance of the oxidation electrode unit, and HCl was continuously supplied to the reduction electrode unit. During the conversion process, formate salt, KCl, an oxygen gas, and water were produced. Since the electrode reaction of carbon dioxide occurs in a neutral condition, in order to convert the produced formate sag into formic acid, the formate sag was acidified by adding HCl. In this case, KCl was produced as a by-product of the reaction. The produced formic acid was isolated from water as a solvent through a distillation or extraction method.

Economic efficiency of the formic acid produced as described above was evaluated. The evaluation of the economic efficiency was conducted for production of about one (1) ton of formic acid, and current efficiency for conversion of carbon dioxide to formic acid by the electrode reaction was calculated to have been about 80%. Tables 1 and 2 below provide the results of the evaluation of the economic efficiency.

TABLE 1

Consumption Cost according to the Evaluation of Economic Efficiency under a Bicarbonate Solution Condition

| | Consumption | | | | | |
|---|---|---|---|---|---|---|
| | Materials | Mol | Molecular Weight | Consumption (ton) | Price ($/ton) | Value (Consumption * price, $) |
| Oxidation Electrode Unit | $H_2O$ | 1 | 18 | 0.4 | 0 | 0 |
| | KOH | 1 | 56.1 | 2.4 | 900 | 2,195 |
| Reduction Electrode Unit | HCl | 1 | 36.5 | 0.8 | 350 | 278 |
| | $CO_2$ | 1 | 44 | 1.0 | 0 | 0 |
| | Electricity Consumption | | 80% | 5.25 | 50 | 262.5 |
| Acidification Reaction and Extraction/ | HCl | 1 | 36.5 | 0.8 | 350 | 778 |
| | Distillation/ Extraction | | | | | 100 |

TABLE 1-continued

| Consumption Cost according to the Evaluation of Economic Efficiency under a Bicarbonate Solution Condition | | | | | | |
|---|---|---|---|---|---|---|
| | Consumption | | | | | |
| | Materials | Mol | Molecular Weight | Consumption (ton) | Price ($/ton) | Value (Consumption * price, $) |
| Distillation Operation Cost | | | | | | 150 |
| Total | | | | | Consumption Cost | 3,263 |

TABLE 2

| Profit according to the Evaluation of Economic Efficiency under a Bicarbonate Solution Condition | | | | | | |
|---|---|---|---|---|---|---|
| | Production | | | | | |
| | Materials | Mol | Molecular Weight | Produced amount (ton) | Price ($/ton) | Value (Produced amount * price, $) |
| Oxidation Electrode Unit | $O_2$ | 0.5 | 16 | 0.2 | 100 | 17 |
| | $H_2O$ | 2 | 18 | 0.8 | 0 | 0 |
| Reduction Electrode Unit | KCl | 1 | 74.5 | 1.6 | 500 | 810 |
| Acidification Reaction | HCOOH | 1 | 46 | 1.0 | 1,000 | 1,200 |
| | KCl | 1 | 74.5 | 1.6 | 500 | 810 |
| Total | | | | | Profit | 2,837 |
| Difference | 2,837 − 3,263 = −426 | | | | | |

According to the above experiment results, while the electrochemical conversion efficiency of carbon dioxide effectively occurred with the efficiency of about 80% or more, it was identified that the process makes a loss of about $426 dollars per production of about one (1) ton of formic acid in view of the prices of the solutions that should be supplied from the outside for the ion balance with the solutions to be used.

Test Example 1

In accordance with an illustrative embodiment of the present disclosure, evaluation of economic efficiency of the formic acid produced according to the electrochemical conversion process of carbon dioxide as in Examples 1 and 2 above was conducted. The evaluation was based on electricity consumption, assuming that current efficiency for the electrochemical conversion of carbon dioxide is about 60%, and Tables 3 and 4 below provide the evaluation results.

TABLE 3

| Consumption Cost according to the Evaluation of Economic Efficiency under a Potassium Sulfate Solution Condition | | | | | | |
|---|---|---|---|---|---|---|
| | Consumption | | | | | |
| | Materials | Mol | Molecular Weight | Consumption (ton) | Price ($/ton) | Value (Consumption * price, $) |
| Oxidation | $H_2O$ | 1 | 18 | 0.4 | 0 | 0 |
| Electrode Unit | KOH | 1 | 56.1 | 1.2 | 900 | 1,098 |
| Reduction | $CO_2$ | 1 | 44 | 1.0 | 0 | 0 |
| Electrode Unit | Electricity Consumption | | 70% | 5.25 | 50 | 300 |

TABLE 3-continued

Consumption Cost according to the Evaluation of Economic Efficiency under a Potassium Sulfate Solution Condition

| | Consumption | | | | | |
|---|---|---|---|---|---|---|
| | Materials | Mol | Molecular Weight | Consumption (ton) | Price ($/ton) | Value (Consumption * price, $) |
| Extraction and Distillation | $H_2SO_4$ | 0.5 | 98 | 1.1 | 80 | 85 |
| | Distillation/ Extraction | | | | | 100 |
| Operation Cost | | | | | | 150 |
| Total | | | | | Consumption Cost | 1,733 |

TABLE 4

Profit according to the Evaluation of Economic Efficiency under a Potassium Sulfate Solution Condition

| | Production | | | | | |
|---|---|---|---|---|---|---|
| | Materials | Mol | Molecular Weight | Produced amount (ton) | Price ($/ton) | Value (Produced amount * price, $) |
| Oxidation Electrode Unit | $O_2$ | 0.5 | 16 | 0.2 | 100 | 17 |
| Reduction Electrode Unit | $H_2O$ | 1 | 18 | 0.4 | 0 | 0 |
| Extraction | HCOOH | 1 | 46 | 1.0 | 12,000 | 1,200 |
| | $K_2SO_4$ | 0.5 | 174.25 | 1.9 | 800 | 1,515 |
| Total | | | | | Profit | 2,733 |
| Difference | 2,733 − 1,733 = 1,000 | | | | | |

As seen from the above results, in addition to formic acid, which is the product of the electrochemical conversion of carbon dioxide, potassium sulfate produced after the acidification reaction using sulfuric add also exhibited high economic efficiency. An economic effect of about $1000 per production of about one (1) ton of formic acid can be expected, and this effect is an increase of about 2.5 times over the conventional solution process.

The above description of the present disclosure is provided for the purpose of illustration, and it would be understood by those skilled in the art that various changes and modifications may be made without changing technical conception and essential features of the illustrative embodiments. Thus, it is clear that the above-described examples are illustrative in all aspects and do not limit the present disclosure. For example, each component described to be of a single type can be implemented in a distributed manner. Likewise, components described to be distributed can be implemented in a combined manner.

The scope of the inventive concept is defined by the following claims and their equivalents rather than by the detailed description of the present disclosure. It shall be understood that all modifications and embodiments conceived from the meaning and scope of the claims and their equivalents are included in the scope of the inventive concept.

We claim:

1. An electrochemical reduction method of carbon dioxide, comprising:

supplying a solution containing carbon dioxide and potassium sulfate into a reduction electrode unit in an electrochemical reactor;

supplying a solution containing potassium sulfate into an oxidation electrode unit in the electrochemical reactor; and applying a current to the reduction electrode unit and the oxidation electrode unit to reduce the carbon dioxide in the reduction electrode unit, wherein the reduction electrode unit includes an amalgam electrode, wherein the amalgam electrode includes a dental amalgam, and wherein the dental amalgam includes Hg of from 35 wt % to 55 wt %, Ag of from 14 wt % to 34 wt %, Sn of from 7 wt % to 17 wt %, and Cu of from 4 wt % to 24 wt %.

2. The electrochemical reduction method of claim 1, wherein the current ranges from 2 $mA/cm^2$ to 50 $mA/cm^2$.

3. The electrochemical reduction method of claim 1, wherein a concentration of the solution containing potassium sulfate ranges from 0.1 M to 10 M.

4. The electrochemical reduction method of claim 1, wherein a conversion efficiency of carbon dioxide by the electrochemical reduction method is 50% or more.

5. The electrochemical reduction method of claim 1, further comprising:

adding a solution containing KOH into the oxidation electrode unit to control pH.

* * * * *